US007387367B2

(12) United States Patent
Furukawa et al.

(10) Patent No.: US 7,387,367 B2
(45) Date of Patent: Jun. 17, 2008

(54) IMAGE FORMING APPARATUS

(75) Inventors: Gentaro Furukawa, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 337 days.

(21) Appl. No.: 11/180,680

(22) Filed: Jul. 14, 2005

(65) Prior Publication Data

US 2006/0012637 A1 Jan. 19, 2006

(30) Foreign Application Priority Data

Jul. 16, 2004 (JP) ..... 2004-210262

(51) Int. Cl.
*B41J 2/06* (2006.01)
*B41J 2/165* (2006.01)

(52) U.S. Cl. ..... 347/55; 347/34

(58) Field of Classification Search ..... 347/26, 347/34, 55, 90, 5, 36
See application file for complete search history.

(56) References Cited

U.S. PATENT DOCUMENTS

| | | | |
|---|---|---|---|
| 5,646,659 | A | 7/1997 | Moriyama et al. |
| 5,896,148 | A | 4/1999 | Fukushima et al. |
| 6,097,408 | A | 8/2000 | Fukushima et al. |
| 6,802,591 | B2 | 10/2004 | Takahashi |
| 2003/0151639 | A1 | 8/2003 | Takahashi |

FOREIGN PATENT DOCUMENTS

| | | | |
|---|---|---|---|
| JP | 63-15754 | A | 1/1988 |
| JP | 5-124187 | A | 5/1993 |
| JP | 2000-25249 | A | 1/2000 |
| JP | 2001-301134 | A | 10/2001 |
| JP | 2002-154226 | | 5/2002 |
| JP | 2003-341109 | A | 12/2003 |

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The image forming apparatus comprises: an ejection head which ejects a droplet of liquid onto a recording medium; an electric field generating device which generates an electric field, the electric field generating device being arranged in a position facing an ejection face of the ejection head across the recording medium; and a control device which controls intensity of the electric field to attract mist of the liquid toward the electric field generating device, the mist of the liquid being produced when the droplet of the liquid is ejected by the ejection head.

8 Claims, 10 Drawing Sheets

IMAGE FORMING APPARATUS

BACKGROUND OF THE INVENTION

1. Field of the Invention

The present invention relates to an image forming apparatus, and more particularly to an image forming apparatus which forms an image on a recording medium by depositing liquid droplets on the recording medium through nozzles.

2. Description of the Related Art

An inkjet image forming apparatus forms an image on a recording medium by depositing ink on the recording medium through nozzles provided in a print head. Various conventional methods for ejecting ink from the image forming apparatus are known, including: a piezoelectric method in which a diaphragm constituting a part of a pressure chamber (ink chamber) is deformed by the deformation of a piezoelectric element (piezoelectric actuator), thereby varying the volume of the pressure chamber such that when the pressure chamber volume is increased, ink is introduced into the pressure chamber through an ink supply passage, and when the pressure chamber volume is reduced, the ink inside the pressure chamber is ejected through the nozzle as an ink droplet; and a thermal inkjet method in which bubbles are formed by heating the ink, and ink droplets are ejected by the expansion energy generated as the bubbles grow.

When ink droplets are ejected through the nozzles in accordance with such ink ejection methods, a minute ink mist in droplet form may occur. This ink mist has negative charge due to the friction generated upon ejection of the ink droplets. If a nozzle face (ejection face) of the print head has positive charge or the recording medium has negative charge at this time, the resultant electrostatic force causes the ink mist to adhere to the nozzle face of the print head. When the ink mist adhered to the nozzle face contacts the ink droplets ejected from the nozzles, a phenomenon whereby the ink droplets do not travel in the desired ejection direction, or in other words defective ejection, occurs.

Various techniques for preventing ink mist adhesion during ink ejection have been proposed.

Japanese Patent Application Publication No. 63-15754 discloses a technique of removing electricity from the nozzle face of a print head without damaging the nozzle face.

According to this document, an electricity-removing electrode is provided in a standby position facing the nozzle face of the print head, where the print head does not perform an ink ejection operation, rather than a position at which the print head performs the ink ejection operation to deposit ink onto the recording medium. An electricity-removing voltage is applied to the electricity-removing electrode so that the electric field becomes zero or opposite to the initial electric field, and in so doing, ink mist is prevented from adhering to the nozzle face.

However, in this technique, the electricity-removing electrode is disposed in the standby position of the print head, and is therefore unable to remove electricity from the nozzle face while the print head is performing the ink ejection operation. As a result, the ink mist that is generated during ink ejection may adhere to the nozzle face before electricity is removed from the nozzle face in the standby position of the print head, and hence defective ejection through the nozzles may still occur.

Japanese Patent Application Publication No. 2003-341109 discloses a technique for preventing liquid mist (ink mist) from adhering to the edge portion on the rear of the print surface of a recording medium and the inside of the apparatus when ink droplets are deposited onto the edge portions of the recording medium such that no margins remain. According to this document, an electrostatic charging member is provided in an area facing the print head on the rear of the print surface of the recording medium being printed, and static electricity charged to the electrostatic charging member by a static electricity generating member is used to collect liquid mist generated at the edge portion on the rear of the print surface of the recording medium and in the inside of the apparatus.

However, in this technique, the electric field is not adjustable, and hence when the electric field is too strong during ink ejection, the ink droplets ejected through the nozzles may be affected by the electric field. This may result in such adverse effects as so-called oblique ejection, in which the ink droplets travel in an oblique direction, an increase in the ink droplet ejection speed or ejection amount, and an increase in ink mist and so on.

SUMMARY OF THE INVENTION

The present invention has been contrived in view of these circumstances, and it is an object thereof to provide an image forming apparatus which is capable of preventing ink mist from adhering to a nozzle face of a print head during an ink ejection operation performed by the print head, without affecting the ink droplets ejected from the print head.

In order to attain the aforementioned object, the present invention is directed to an image forming apparatus, comprising: an ejection head which ejects a droplet of liquid onto a recording medium; an electric field generating device which generates an electric field, the electric field generating device being arranged in a position facing an ejection face of the ejection head across the recording medium; and a control device which controls intensity of the electric field to attract mist of the liquid toward the electric field generating device, the mist of the liquid being produced when the droplet of the liquid is ejected by the ejection head.

According to the present invention, the electric field generating device is disposed in a position facing the ejection face of the ejection head with the recording medium therebetween, and therefore an electric field having sufficient intensity to attract the ink mist produced by ink ejection toward the electric field generating device can be generated through the control performed by the control device not only when no liquid droplets are ejected from the ejection head, but also when liquid droplets are ejected.

When the ejection head deposits the ink droplets onto the recording medium, an electric field having sufficient intensity to attract the ink mist toward the electric field generating device can be applied to the ink mist without affecting the ink droplets, and when no ink droplets are ejected from the ejection head, a greater electric field intensity than the electric field intensity generated during ink droplet ejection can be applied to the ink mist.

As a result, ink mist can be prevented from adhering to the ejection face of the ejection head without affecting the ink droplets that are ejected from the ejection head, and hence the ink mist collection performance can be improved.

The term "recording medium" indicates a medium on which an image is recorded by means of the action of the inkjet head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an inkjet head, and the like.

Preferably, the image forming apparatus further comprises: a measurement device which measures the intensity of the electric field in a flight space of the droplet of the liquid and the mist of the liquid, wherein the control device controls the intensity of the electric field generated by the electric field generating device according to the electric field intensity measured by the measurement device.

According to the present invention, control can be performed on the basis of the electric field intensity measured by the measurement device, and hence optimum control of the electric field intensity can be performed.

The flight space of the liquid droplet and the liquid mist refers to the space existing between the ejection face of the ejection head and the recording medium.

Preferably, the measurement device measures a potential difference between the recording medium and the ejection head.

According to the present invention, control can be performed on the basis of the potential difference measured by the measurement device, and hence optimum control of the electric field intensity can be performed even when changes occur in the presence or absence of the recording medium, the type and thickness of the recording medium, and so on.

Preferably, the control device controls the intensity of the electric field in a flight space of the droplet of the liquid and the mist of the liquid to no less than 1.19 kV/m and less than 2.46 kV/m during the ejection head ejecting the droplet of the liquid.

According to the present invention, when the electric field intensity in the flight space of the liquid droplet and the liquid mist is no less than 1.19 kV/m and less than 2.46 kV/m during the liquid ejection, it is possible to attract 0.1 pl to 0.5 pl of the liquid mist alone toward the electric field generating device without affecting the liquid droplet ejected from the ejection head.

Preferably, the image forming apparatus further comprises a moving device which changes a distance between the electric field generating device and the ejection head.

According to the present invention, by controlling the electric field intensity and also varying the relative distance between the electric field generating device and the ejection face of the ejection head, the effect of the electric field on the liquid droplet and the liquid mist can be reduced or increased rapidly when sudden disturbances occur.

In order to attain the aforementioned object, the present invention is also directed to an image forming apparatus, comprising: a plurality of ejection heads which eject droplets of liquid onto a recording medium; a plurality of electric field generating devices which generate electric fields, each of the plurality of electric field generating devices being arranged in a position facing an ejection face of each of the plurality of ejection heads across the recording medium; and a control device which controls intensity of the electric fields to attract mist of the liquid toward the plurality of electric field generating devices, the mist of the liquid being produced when the droplets of the liquid are ejected by the plurality of ejection heads.

According to the present invention, the electric field generating device is provided for each ejection head, and hence an optimum electric field intensity can be generated in accordance with each ejection head and the peripheral conditions of each ejection head. For example, when the physical properties of the liquid in each ejection head differ, an electric field taking these differences into account can be generated.

According to the present invention, the electric field generating device is disposed in a position facing the ejection face of the ejection head with the recording medium therebetween, and therefore an electric field having sufficient intensity to attract ink mist toward the electric field generating device can be generated through the control performed by the control device not only when no liquid droplets are ejected from the ejection head, but also when liquid droplets are ejected.

When the ejection head deposits the liquid droplets onto the recording medium, an electric field having sufficient intensity to attract the ink mist toward the electric field generating device can be applied to the ink mist without affecting the liquid droplets, and when no liquid droplets are ejected from the ejection head, a greater electric field intensity than the electric field intensity generated during liquid droplet ejection can be applied to the ink mist.

As a result, ink mist can be prevented from adhering to the ejection face of the ejection head without affecting the liquid droplets that are ejected from the ejection head, and hence the ink mist collection performance can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Overall Constitution of Inkjet Recording Apparatus

Figure 1:
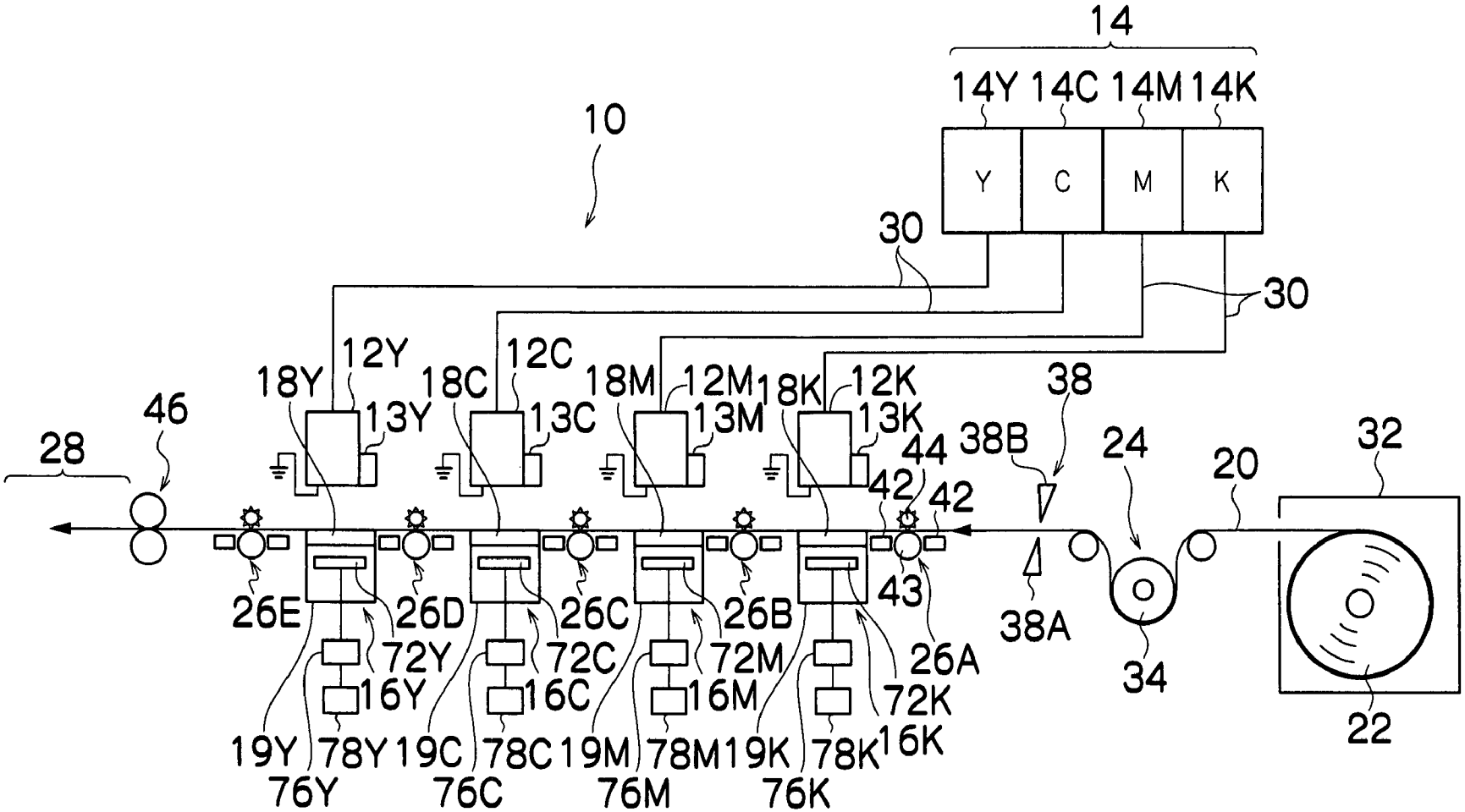
FIG. 1 is a general schematic drawing of an inkjet recording apparatus according to a first embodiment of an image forming apparatus of the present invention.

FIG. 1 is a general schematic drawing of an inkjet recording apparatus according to a first embodiment of the present invention. As shown in FIG. 1, an inkjet recording apparatus 10 comprises: a plurality of print heads 12K, 12M, 12C, 12Y provided for ink colors of black (K), magenta (M), cyan (C), yellow (Y), respectively; an ink storing and loading unit 14 in which the inks supplied to the print heads 12K, 12M, 12C, 12Y are stored; a paper supply unit 22, which supplies recording paper 20 serving as a recording medium; a decurling unit 24, which removes curls from the recording paper 20; support units 16K, 16M, 16C, 16Y disposed opposite a nozzle face (ink ejection face) of each print head 12K, 12M, 12C, 12Y for supporting the recording paper 20 while maintaining the flatness of the recording paper 20; conveyance units 26A, 26B, 26C, 26D, 26E, which convey the recording paper 20; and a paper output unit 28, which outputs the recorded paper (printed object) to the outside.

The ink storing and loading unit 14 has ink tanks 14K, 14M, 14C, and 14Y, for storing the inks of K, M, C and Y to be supplied to the print heads 12K, 12M, 12C, and 12Y, and the tanks are connected to the print heads 12K, 12M, 12C, and 12Y by means of prescribed channels 30. The ink storing and loading unit 14 has a warning device (for example, a display device or an alarm sound generator) for warning when the remaining amount of any ink is low, and has a mechanism for preventing loading errors among the colors.

In FIG. 1, a magazine 32 for rolled paper (continuous paper) is shown as an example of the paper supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, whose length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

Following the decurling, the cut recording paper 20 is conveyed to the conveyance unit 26A. The conveyance unit 26A is constituted by guide members 42, 42, which support the recording paper 20, a drive roller 43 disposed between the guide members 42, 42 so as to pinch the recording paper 20, and a toothed driven roller 44. The outer peripheral surface of the toothed driven roller 43 is formed with gear-shaped protrusions and recesses such that the tip ends of the protrusions contact the recording paper 20. When the power of a motor 134 (not shown in FIG. 1, but shown in FIG. 7) is transmitted to the drive roller 43, the recording paper 20 pinched between the drive roller 43 and the toothed driven roller 44 is conveyed from right to left in FIG. 1. Conveyance units 26B, 26C, 26D, and 26E disposed downstream of the conveyance unit 26A are constituted similarly to the conveyance unit 26A.

The support units 16K, 16M, 16C, 16Y are constituted mainly by platens 18K, 18M, 18C, 18Y and liquid reception units 19K, 19M, 19C, 19Y. The comb-tooth form platens 18K, 18M, 18C, 18Y are disposed on the upper faces (the support faces, which support the recording paper 20) of the support units 16K, 16M, 16C, 16Y, respectively. The liquid reception units 19K, 19M, 19C, 19Y are connected to the rear surface side of the platens 18K, 18M, 18C, 18Y, respectively.

Each of the print heads 12K, 12M, 12C, 12Y is configured as a full line head having a length corresponding to the maximum paper width of the recording paper 20 used in the inkjet recording apparatus 10. A plurality of ink ejection nozzles are arranged in the nozzle face of each of the print heads 12K, 12M, 12C, 12Y over a length which exceeds at least one side of the maximum size recording paper 20 (the entire width of the printable range).

The print heads 12K, 12M, 12C and 12Y are arranged in color order (black (K), magenta (M), cyan (C), yellow (Y)) from the upstream side in the feed direction of the recording paper 20, and these print heads 12K, 12M, 12C and 12Y are fixed extending in a direction substantially perpendicular to the conveyance direction of the recording paper 20.

A color image can be formed on the recording paper 20 by ejecting inks of different colors from the print heads 12K, 12M, 12C and 12Y, respectively, onto the recording paper 20 while the recording paper 20 is conveyed by the conveyance unit 26.

By providing the full line heads 12K, 12M, 12C, 12Y having nozzle arrays that cover the entire paper width for the respective colors, an image can be recorded on the entire surface of the recording paper 20 by performing an operation to move the recording paper 20 relatively to the print heads 12K, 12M, 12C, 12Y in the paper conveyance direction (sub-scanning direction) a single time (i.e., with a single sub-scan). With the image forming apparatus employing this single pass system, it is possible to achieve a higher print speed than that of a shuttle scan system, in which the print head performs a reciprocating movement in a direction (main scanning direction) orthogonal to the sub-scanning direction. Thus, an improvement in productivity can be achieved.

Although the configuration with the KMCY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the print heads of the colors are arranged.

A pressure fixing roller 46 is provided downstream of the print head 12Y. The pressure fixing roller 46 is a device for controlling the glossiness and evenness of the image surface, and applies a predetermined pressure to the image surface.

A printed object created in this manner is outputted from the paper output unit 28. Although not shown in FIG. 1, a sorter is provided on the paper output unit 28 to sort images according to type.

In addition to the apparatus constitution described above, the inkjet recording apparatus 10 of the present embodiment comprises: charging members 72K, 72M, 72C, 72Y provided in the interior of the liquid reception portions 19K, 19M, 19C, 19Y, respectively; potentiometers 13K, 13M, 13C, 13Y provided adjacent to the print heads 12K, 12M, 12C, 12Y, respectively, on the upstream side of the paper conveyance direction; voltage adjusters 76K, 76M, 76C, 76Y connected to the charging members 72K, 72M, 72C, 72Y, respectively; and power source units 78K, 78M, 78C, 78Y. These elements serve to prevent ink mist from adhering to the nozzle face. The constitutions, operations, and so on employed in the apparatus to prevent ink mist from adhering to the nozzle face will be described later.

Structure of Print Head

Next, the structure of the print head will be described. The print heads 12K, 12M, 12C, 12Y provided for the respective ink colors have a common structure, and hence in the following description, a print head having the reference numeral 50 will be used as a representative thereof.

Figure 2A:
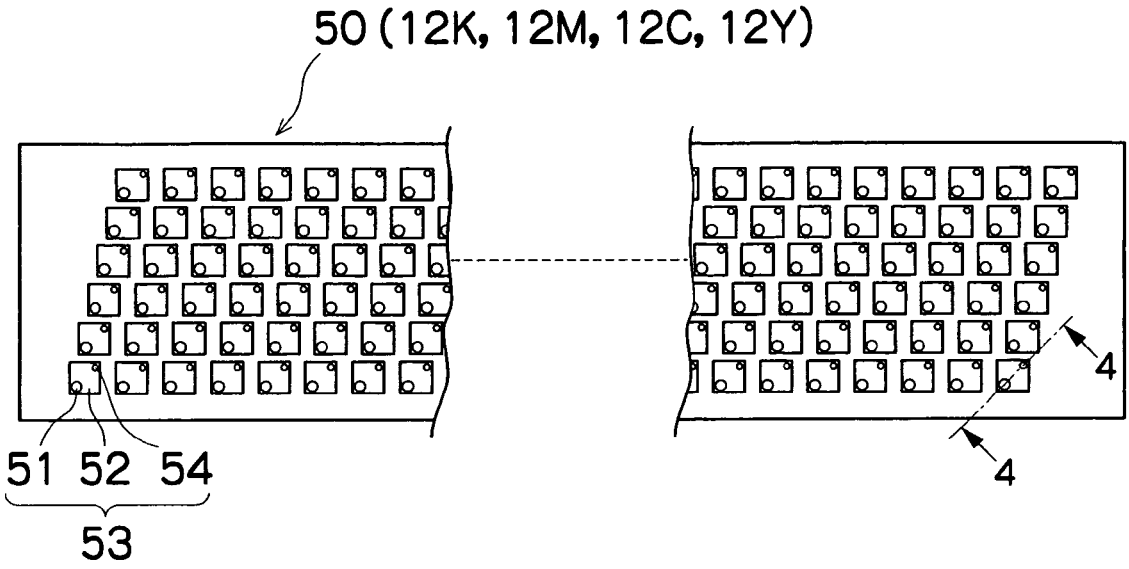
FIG. 2A is a projected plan view showing a structural example of a print head.
Figure 2B:
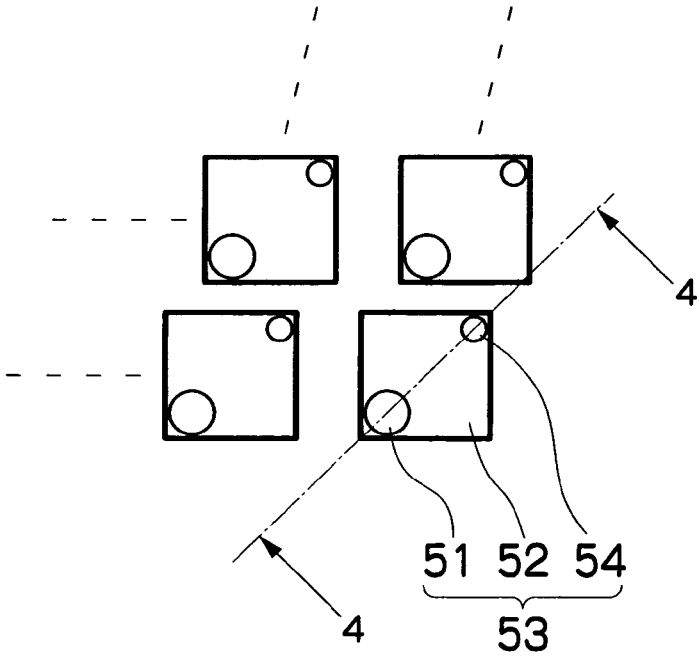
FIG. 2B is a partially expanded view thereof.
Figure 3:
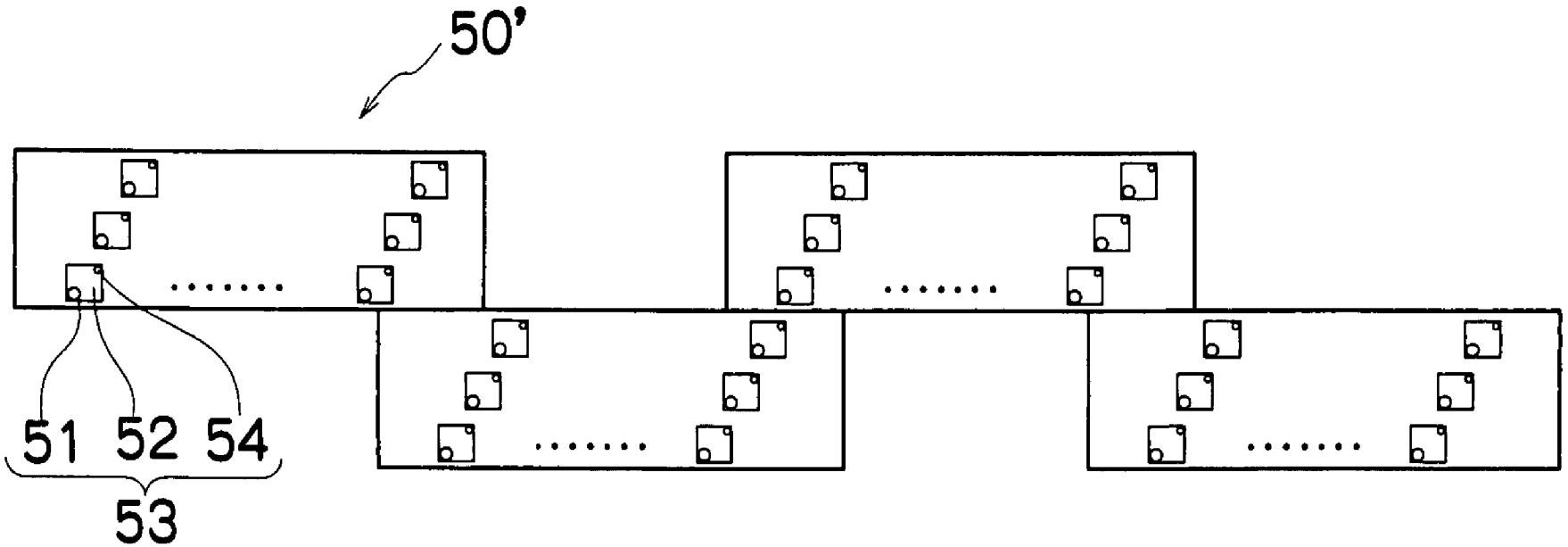
FIG. 3 is a projected plan view showing another structural example of a print head.
Figure 4:
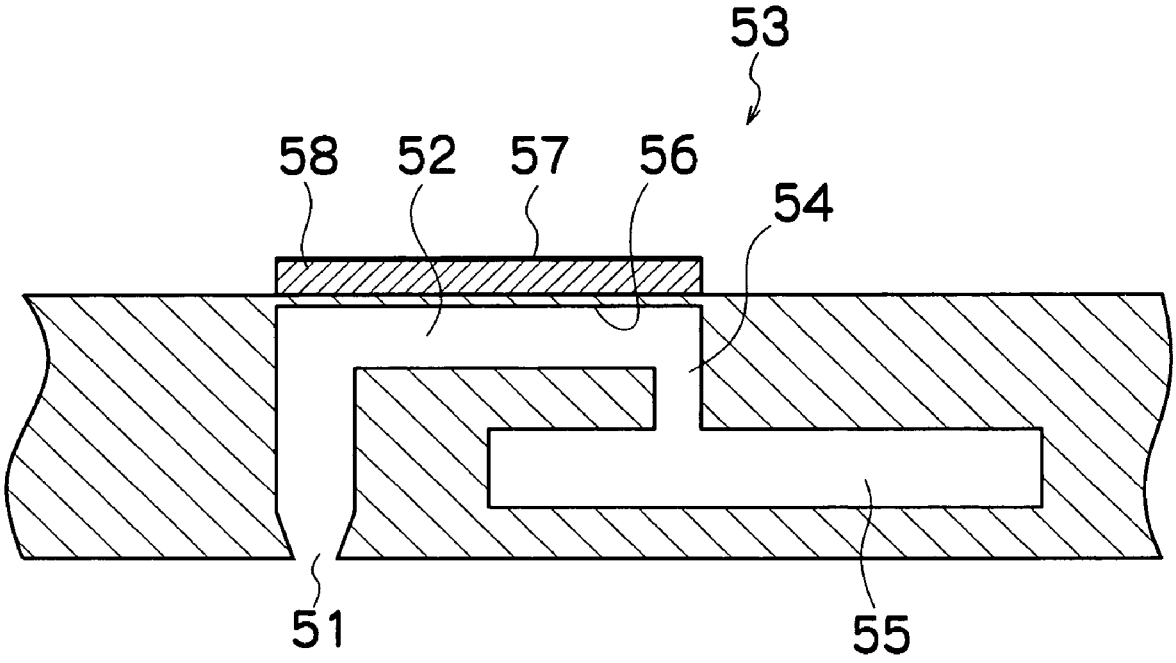
FIG. 4 is a sectional view along a line 4-4 in FIGS. 2A and 2B.

FIG. 2A is a perspective plan view showing an example of the configuration of the print head 50, FIG. 2B is an enlarged view of a portion thereof, FIG. 3 is a perspective plan view showing another example of the configuration of the print head 50, and FIG. 4 is a cross-sectional view taken along the line 4-4 in FIGS. 2A and 2B, showing the inner structure of a droplet ejection element (an ink chamber unit for one nozzle 51).

The nozzle pitch in the print head 50 should be minimized in order to maximize the density of the dots printed on the surface of the recording paper. As shown in FIGS. 2A to 4, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction perpendicular to the paper conveyance direction) is reduced and high nozzle density is achieved.

Instead of the constitution shown in FIGS. 2A and 2B, short head units 50', in which the plurality of nozzles 51 are arranged two-dimensionally, may be arranged in staggered form and connected to form a full line head having nozzle arrays with a length corresponding to the entire width of the recording paper 20, as shown in FIG. 3.

As shown in FIGS. 2A and 2B, the planar shape of the pressure chamber 52 provided for each nozzle 51 is substantially a square, and the nozzle 51 and an inlet of supplied ink (supply port) 54 are disposed in both comers on a diagonal line of the square.

As shown in FIG. 4, the pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is joined to a pressure plate (common electrode) 56 constituting the ceiling face of the pressure chamber 52. By applying a drive voltage to the individual electrode 57 and the common electrode 56, the actuator 58 deforms, thereby altering the volume of the pressure chamber 52. This volume alteration leads to a variation in pressure which causes ink to be ejected from the nozzles 51. A piezoelectric body such as a piezo element is preferably used as the actuator 58. After the ink has been ejected, new ink is supplied to the pressure chamber 52 from a common flow passage 55 via a supply port 54.

Figure 5:
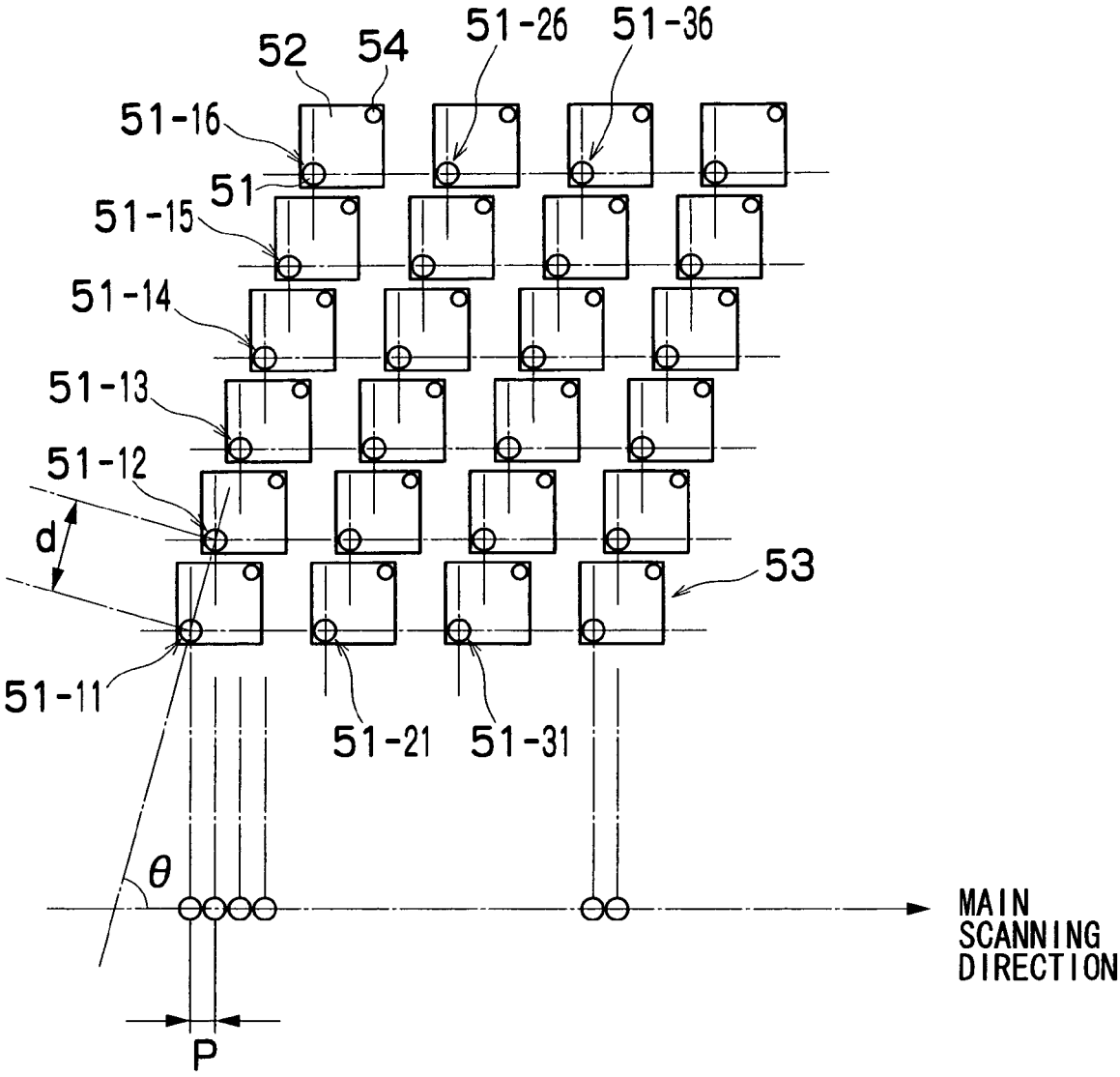
FIG. 5 is an enlarged view showing a nozzle array in the print head shown in FIGS. 2A and 2B.

As shown in FIG. 5, the large number of ink chamber units 53 constituted in this manner are arranged in a constant, lattice-form array pattern along a row direction in the main scanning direction and a column direction which is not orthogonal to the main scanning direction, but oblique at a constant angle $\theta$. By arranging the plurality of ink chamber units 53 at a constant pitch d in the direction of the angle $\theta$ relative to the main scanning direction, a pitch P of the nozzles projected so that the nozzles line up in the main scanning direction is $d \times \cos\theta$.

In other words, the main scanning direction may be considered equivalent to a direction in which the nozzles 51 are arranged in a straight line at a constant pitch P. As a result of this constitution, it is possible to realize a high nozzle density of 2,400 nozzles per inch when the nozzle arrays are projected so as to line up in the main scanning direction.

When the nozzles are driven in a full line head having nozzle arrays with a length corresponding to the entire printable width of the recording paper 20, an operation such as (1) driving all of the nozzles simultaneously, (2) driving the nozzles in sequence from one nozzle to another, or (3) dividing the nozzles into blocks and driving the nozzles in sequence from one nozzle to another in each block, is performed to print one line or a single strip form in the width direction of the paper (which is orthogonal to the paper conveyance direction).

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 20 by sequentially driving the nozzles 51-11, 51-12, . . . , 51-16 in accordance with the conveyance velocity of the recording paper 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

Upon implementation of the present invention, the configuration of the nozzles is not limited to the example shown in FIG. 5. Furthermore, a method of ejecting ink droplets through deformation of the actuator 58, represented by a piezo element (piezoelectric element), is employed in the present embodiment, but upon implementation of the present invention, there are no limitations on the ink ejection method. Instead of a piezoelectric method, a thermal jet method, in which bubbles are generated by heating the ink using a heat generating body such as a heater, and the ink droplets are ejected by the pressure of the bubbles, or another method may be employed.

Configuration of Ink Supply System

Figure 6:
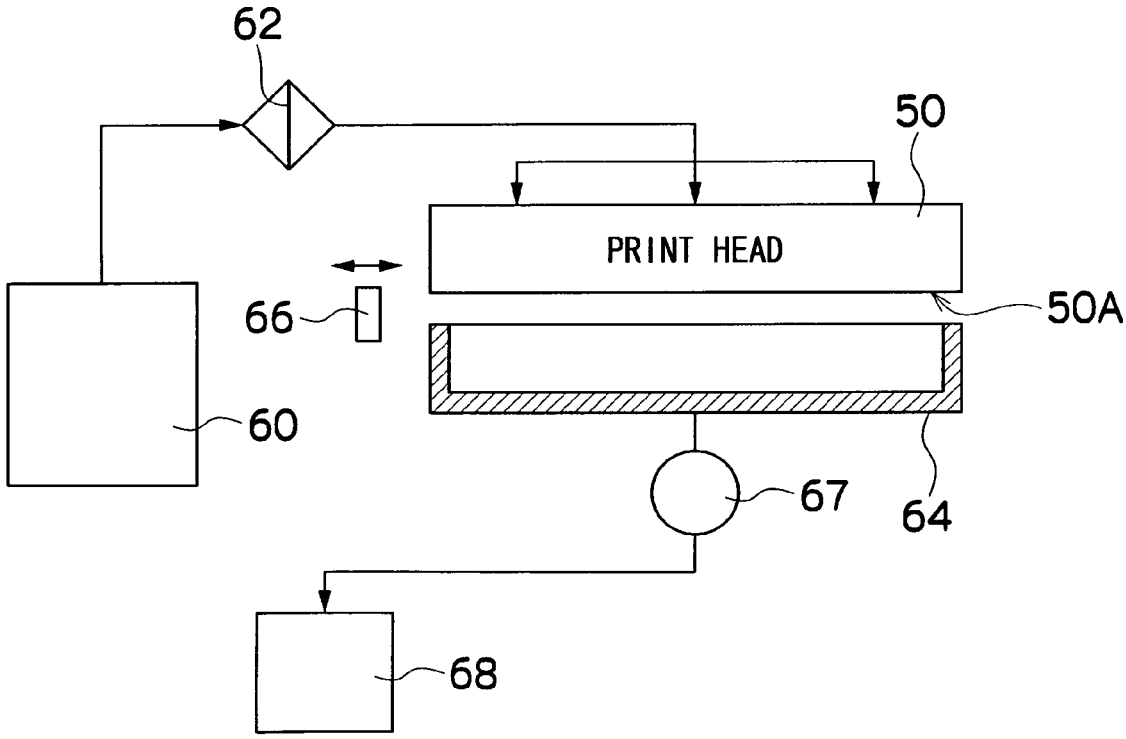
FIG. 6 is a schematic diagram showing the constitution of an ink supply system in the inkjet recording apparatus.

FIG. 6 is a schematic drawing showing the configuration of the ink supply system in the inkjet recording apparatus 10.

The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the print head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is formed from an elastic member made of rubber or the like, and is capable of sliding over the nozzle face 50A of the print head 50 by means of a blade moving mechanism not shown in the drawing. When an ink droplet or foreign object adheres to the nozzle face 50A, the nozzle plate surface can be wiped clean by sliding the cleaning blade 66 over the nozzle face 50A.

During printing or standby, when the frequency of use of specific nozzles 51 is reduced and ink viscosity increases in the vicinity of the nozzles, a preliminary ejection is made to eject the degraded ink toward the cap 64.

Also, when bubbles have become intermixed in the ink inside the print head 50 (inside the pressure chamber), the cap 64 is placed on the print head 50, the ink inside the pressure chamber (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary ejection to eject the ink whose viscosity has increased in the vicinity of the nozzle toward the ink receptor. After the nozzle face 50A is cleaned by a wiper such as the cleaning blade 66 provided as the cleaning device for the nozzle face 50A, a preliminary ejection is also carried out in order to prevent the foreign matter from becoming mixed inside the nozzles 51 by the wiper sliding operation. The preliminary ejection is also referred to as "dummy ejection", "purge", "liquid ejection" and so on.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

When air bubbles become mixed into the ink in the nozzle 51 or pressure chamber 52, or when the viscosity of the ink inside the nozzle 51 has increased to or above a certain level, the ink can no longer be ejected from the nozzle 51 by operating the actuator 58. In such cases, the cap 64 is placed on the nozzle face of the print head 50, and a suction operation is performed to remove the ink intermixed with air bubbles or viscous ink from the pressure chamber 52 using the pump 67.

However, since this suction action is performed with respect to all the ink in the pressure chambers 52, the amount of ink consumption is considerable. Therefore, a preferred aspect is one in which a preliminary ejection is performed when the increase in the viscosity of the ink is small.

The cap 64 functions as a suction device, and also as a preliminary ejection ink receiver, thus corresponding to each of the liquid reception units 19K, 19M, 19C, 19Y in FIG. 1.

Description of Control System

Next, the control system of the inkjet recording apparatus 10 will be described.

Figure 7:
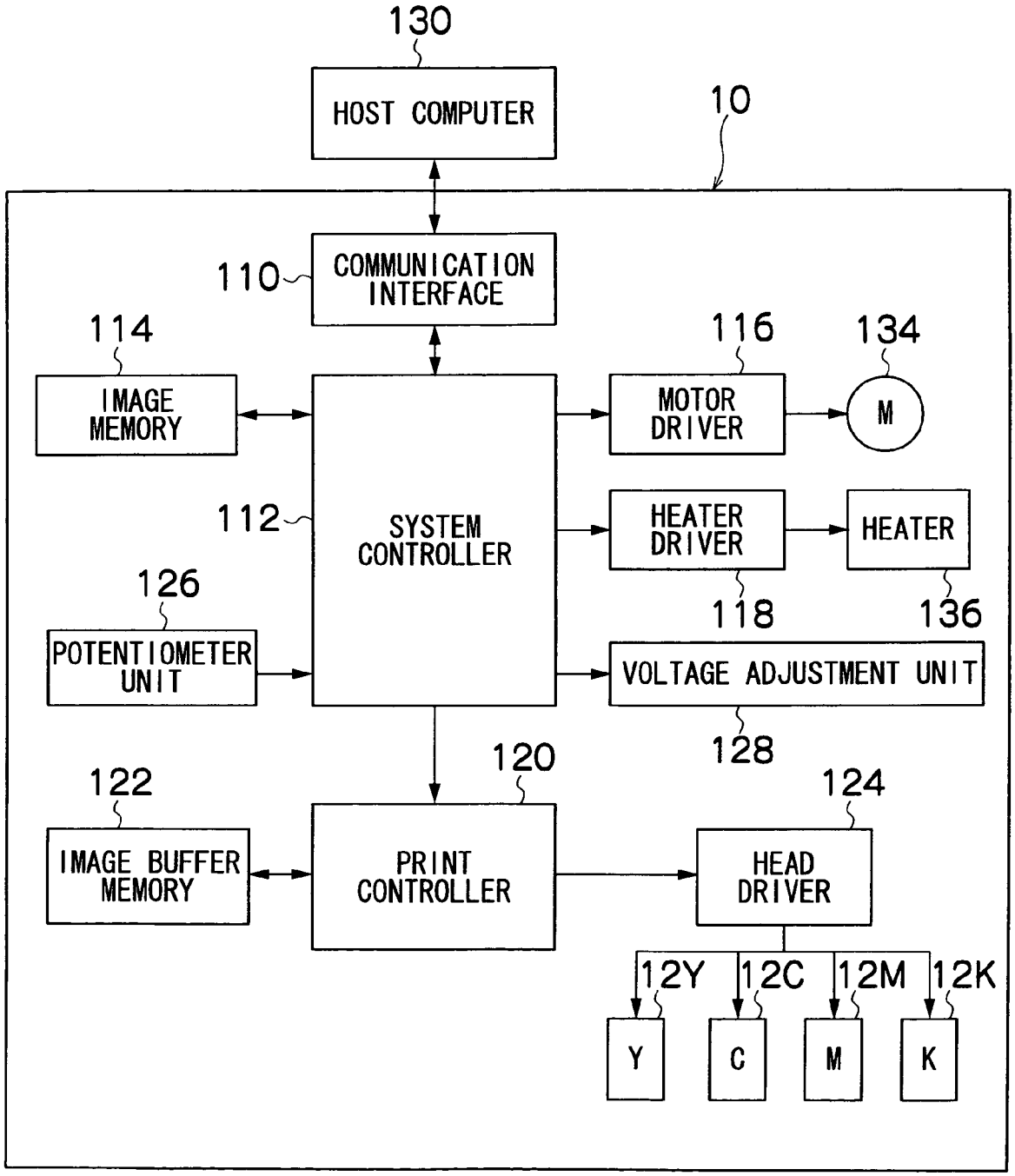
FIG. 7 is a principal block diagram showing the system constitution of the inkjet recording apparatus.

FIG. 7 is a principal block diagram showing the system constitution of the inkjet recording apparatus 10. The inkjet recording apparatus 10 comprises a communication interface 10, a system controller 112, an image memory 114, a motor driver 116, a heater driver 118, a print controller 120, an image buffer memory 122, a head driver 124, a potentiometer unit 126, a voltage adjustment unit 128, and so on.

The communication interface 110 is an interface unit for receiving image data sent from a host computer 130. A serial interface such as USB, IEEE1394, Ethernet, wireless network, or a parallel interface such as a Centronics interface may be used as the communication interface 110. A buffer memory (not shown) may be mounted in this portion in order to increase the communication speed.

The image data sent from the host computer 130 is received by the inkjet recording apparatus 10 through the communication interface 110, and is temporarily stored in the image memory 114. The image memory 114 is a storage device for temporarily storing images inputted through the communication interface 110, and data is written and read to and from the image memory 114 through the system controller 112. The image memory 114 is not limited to a memory composed of semiconductor elements, and a hard disk drive or another magnetic medium may be used.

The system controller 112 is a control unit which controls various units such as the communication interface 110, the image memory 114, the motor driver 116, the heater driver 118, and the voltage adjustment unit 128. The system controller 112 is constituted by a central processing unit (CPU) and the peripheral circuits and so on thereof, and controls communication with the host computer 130, reading and writing in relation to the image memory 114, and so on, as well as generating control signals for controlling a motor 134 and a heater 136 of the conveyance system, and the voltage adjustment unit 128. The motor driver 116 is a driver (drive circuit) which drives the motor 134 in accordance with instructions from the system controller 112. The heater driver 118 is a driver which drives a heating drum 34 and the heater 136 of various other units in accordance with instructions from the system controller 112.

The voltage adjustment unit 128 corresponds to the voltage adjusters 76K, 76M, 76C, 76Y shown in FIG. 1, and applies a predetermined voltage to the charging members 72K, 72M, 72C, 72Y in accordance with an instruction from the system controller 112.

The print controller 120 has a signal processing function for performing various tasks, compensations, and other types of processing for generating print control signals from the image data stored in the image memory 114 in accordance with commands from the system controller 112 so as to supply the generated print control signal (dot data) to the head driver 124. Prescribed signal processing is carried out in the print controller 120, and the ejection amount and the ejection timing of the ink droplets from the print heads 12K, 12M, 12C, 12Y of the respective colors are controlled via the head driver 124, on the basis of the print data. By this means, prescribed dot size and dot positions can be achieved.

The print controller 120 is provided with the image buffer memory 122; and image data, parameters, and other data are temporarily stored in the image buffer memory 122 when image data is processed in the print controller 120. The aspect shown in FIG. 7 is one in which the image buffer memory 122 accompanies the print controller 120; however, the image memory 114 may also serve as the image buffer memory 122. Also possible is an aspect in which the print controller 120 and the system controller 112 are integrated to form a single processor.

The head driver 124 drives the ejection driving actuator 58 of each print head 12K, 12M, 12C, 12Y on the basis of dot data provided by the print controller 120. A feedback control system may be provided in the head driver 124 to maintain constant driving conditions for the print heads.

Image data to be printed are inputted from the outside through the communication interface 110, and stored in the image memory 114. At this stage, RGB image data are stored in the image memory 114, for example. The image data stored in the image memory 114 are transmitted to the print controller 120 via the system controller 112, and in the print controller 120, the image data are converted into dot data for each color using a well-known dithering method, error diffusion method, or similar.

Thus, the print heads 12K, 12M, 12C, 12Y are drive-controlled on the basis of the dot data generated by the print controller 120, whereby ink is ejected from the print heads 12K, 12M, 12C, 12Y. By controlling ink ejection from the print heads 12K, 12M, 12C, 12Y in synchronization with the conveyance speed of the recording paper 20, an image is formed on the recording paper 20.

The inkjet recording apparatus 10 of the present embodiment comprises the potentiometer unit 126 (corresponding to the potentiometers 13K, 13M, 13C, 13Y in FIG. 1) which measures the potential of the recording paper 20. The measurement result of the potentiometer unit 126 is transmitted to the system controller 112.

On the basis of the measurement result from the potentiometer unit 126, the system controller 112 calculates a target electric field intensity of the electric field that is formed by each of the charging members 72K, 72M, 72C, 72Y, and controls the voltage adjustment unit 128 in accordance with the calculation result.

Constitution, Operation, etc. of Apparatus for Preventing Adhesion of Ink Mist to Nozzle Face Next, the constitution, operation, and so on of the inkjet recording apparatus 10 for preventing ink mist from adhering to the nozzle face will be described.

Figure 8:
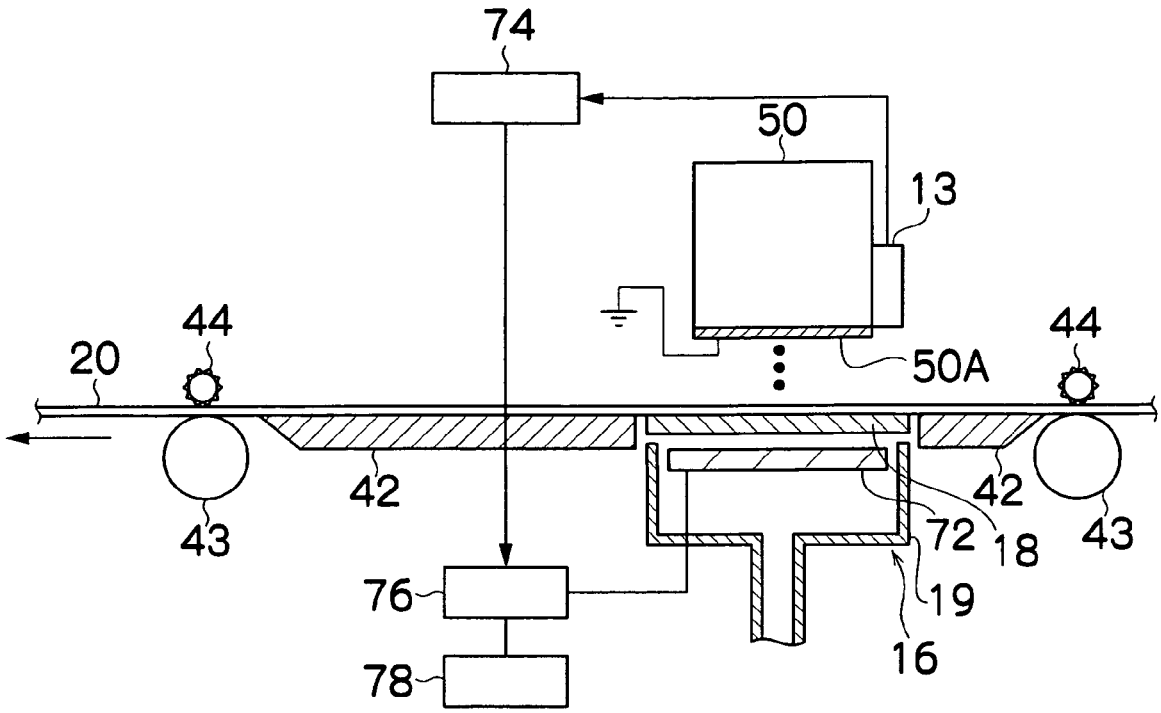
FIG. 8 is an enlarged view of the periphery of the print head shown in FIG. 1.
Figure 9:
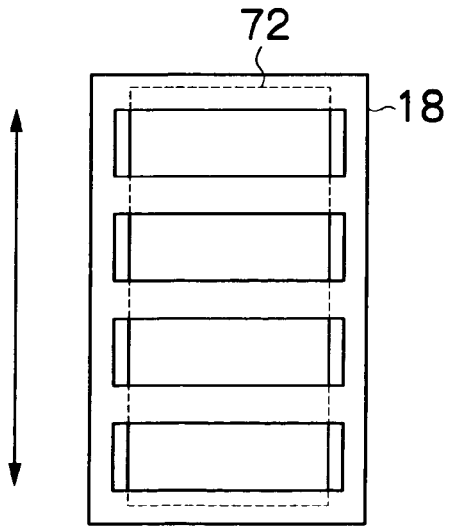
FIG. 9 is a plan view of a charging member and a platen shown in FIG. 8.

FIG. 8 is an enlarged view of the periphery of one print head in the inkjet recording apparatus 10 shown in FIG. 1. FIG. 9 is a plan view of a charging member and a platen shown in FIG. 8. In FIG. 8, identical reference numerals denote parts that are common to FIG. 1, and description of these parts has been omitted. In the following, the support portions 16K, 16M, 16C, 16Y are denoted with the reference numeral 16 for ease of description. Likewise, the potentiometers 13K, 13M, 13C, 13Y are denoted with the reference numeral 13, the voltage adjusters 76K, 76M, 76C, 76Y are denoted with the reference numeral 76, and the power source units 78K, 78M, 78C, 78Y are denoted with the reference numeral 78.

As shown in FIG. 8, the nozzle face 50A of the print head 50 is grounded and neutralized.

The charging member 72 is arranged in the interior of the liquid reception unit 19, which is arranged in a position facing the nozzle face 50A across the recording paper 20. The ink mist that is attracted onto the charging member 72 can be collected by the liquid reception unit 19. The charging member 72 is disposed so as not to contact with the recording paper 20 and the platen 18. The charging member 72 is formed from an electrostatic attraction plate or the like, and is disposed so as to extend in the lengthwise direction (the direction of the arrow in FIG. 9) of the print head 50 (see FIG. 9).

The potentiometer 13 is disposed adjacent to the print head 50 on the upstream side of the paper conveyance direction, shown by the arrow in FIG. 8, and serves to measure the potential of the recording paper 20 provided below the potentiometer 13 in FIG. 8. In the present embodiment, the nozzle face 50A of the print head 50 is grounded, and therefore, by measuring the potential of the recording paper 20, the potential difference between the nozzle face 50A and the recording paper 20 can be found. By measuring the potential of the recording paper 20 using the potentiometer 13, the electric field generated by the charging member 72 can be controlled to an optimum intensity in accordance with the presence or absence of the recording paper 20, the type and thickness of the recording paper 20, and so on.

The control unit 74 corresponds to the system controller 112 in FIG. 7, and is disposed in an arbitrary location in the inkjet recording apparatus 10 (see FIG. 1). The control unit 74 is connected to the potentiometer 13 and the voltage adjuster 76 via a control line (not shown). Further, the voltage adjuster 76 is connected to the power source unit 78 and the charging member 72 via a power line.

According to this constitution, the potentiometer 13 measures the potential of the recording paper 20, and transmits the measurement result to the control unit 74. The control unit 74 controls the voltage adjuster 76 on the basis of the measurement result received from the potentiometer 13 so that the electric field intensity in the flight space of the ink mist that is generated through ejection of ink droplets from the nozzle 51, or in other words at least the space between the nozzle face 50A and the recording paper 20, reaches a predetermined value. On the basis of the control performed by the control unit 74, the voltage adjuster 76 adjusts a supply voltage from the power source unit 78, and applies the adjusted voltage to the charging member 72. The charging member 72 is charged by the applied voltage, and thus generates an electric field having the predetermined intensity.

The intensity of the electric field generated by the charging member 72 varies according to the charging voltage of the charging member 72. The predetermined value of the electric field intensity in the space between the nozzle face 50A and the recording paper 20A is determined so as to have no effect on the ink droplets (i.e., the amount of ink droplet displacement produced by the electric field generated by the charging member 72 is negligible in terms of image quality), and so that only the ink mist is attracted onto the charging member 72.

If the electric field intensity is substantially lower than the predetermined value, the ink mist is not attracted onto the charging member 72, and is therefore more likely to adhere to the nozzle face 50A. On the other hand, if the electric field intensity is substantially higher than the predetermined value, the ink droplets suffer adverse effects such as oblique flight and increases in the ejection speed.

Hence, by maintaining the intensity of the electric field in the space between the nozzle face 50A and the recording paper 20 at the predetermined value, the ink mist can be attracted onto the charging member 72 or the recording paper 20 with no adverse effect on the ink droplets. Thus, the ink mist can be prevented from adhering to the nozzle face 50A.

When the recording paper 20 exists between the charging member 72 and the nozzle face 50A (e.g., during a printing operation by the print head 50), the ink mist may be attracted onto the recording paper 20, but since the ink mist is minute, it has substantially no effect on the image quality.

When an electric field intensity of 2.46 kV/m or more is applied by the charging member 72, an ink droplet of 2 pl is attracted onto the charging member 72. On the other hand, when an electric field intensity of 1.19 kV/m or more is applied, ink mist of between 0.1 pl and 0.5 pl is attracted onto the charging member 72.

Accordingly, to ensure that the ink mist is attracted onto the charging member 72 or the recording paper 20 with no effect on the ink droplets, the predetermined value of the electric field intensity in the flight space of the ink droplets and the ink mist is preferably set to no less than 1.19 kV/m and less than 2.46 kV/m.

Since the charging member 72 is disposed in a position facing the nozzle face 50A of the print head 50 across the recording paper 20, an electric field can be generated by the charging member 72 so that the intensity of the electric field in the flight space of the ink droplets and the ink mist can be maintained at the predetermined value not only when ink ejection is not performed by the print head 50, but also during ink ejection. Thus, the ink mist can be prevented from adhering to the nozzle face 50A even during the ink ejection operation of the print head.

In the present embodiment in particular, control is preferably performed to make the electric field intensity during ink ejection from the print head 50 smaller than the electric field intensity when ink is not ejected. During ink ejection from the print head 50, the flight direction, ejection speed, ejection amount, and so on of the ink droplets are affected easily by the electric field, and hence by making the electric field intensity during ink ejection smaller than the electric field intensity when ink is not ejected, these effects on the ink droplets can be suppressed. When no ink is ejected, no ink droplets travel, and hence by increasing the electric field intensity, the ink mist collection performance can be improved.

The charging member 72, the potentiometer 13, and the voltage adjuster 76 shown in FIG. 8 are provided for each of the print heads 12K, 12M, 12C, 12Y, as shown in FIG. 1.

In the present embodiment, the intensity of the electric fields generated by the respective charging members 72K, 72M, 72C, 72Y (see FIG. 1) can be controlled individually. In other words, the control unit 74 can control the voltages applied to the respective charging members 72K, 72M, 72C, 72Y individually. In this case, the predetermined values of the electric field intensity in the spaces between the nozzle faces of the print heads 12K, 12M, 12C, 12Y and the recording paper 20 may be standardized or set individually.

When the recording paper 20 passes through the electric field, the intensity of the electric field formed between the nozzle face of each print head 12K, 12M, 12C, 12Y and each charging member 72K, 72M, 72C, 72Y may vary according to the wetness of the recording paper 20 produced by the deposited ink. Moreover, when passing through the electric field on the downstream side of the paper conveyance direction, the recording paper 20 is wetter than on the upstream side, and hence the electric field intensity may not be constant on the upstream and downstream sides. Furthermore, the effect of the electric field on the ink mist may differ according to the type of ink (dye or pigment, color, and so on) used in each print head 12K, 12M, 12C, 12Y. It is therefore preferable to individually control the intensities of the electric field generated by the charging members 72K, 72M, 72C, 72Y.

Figure 10:
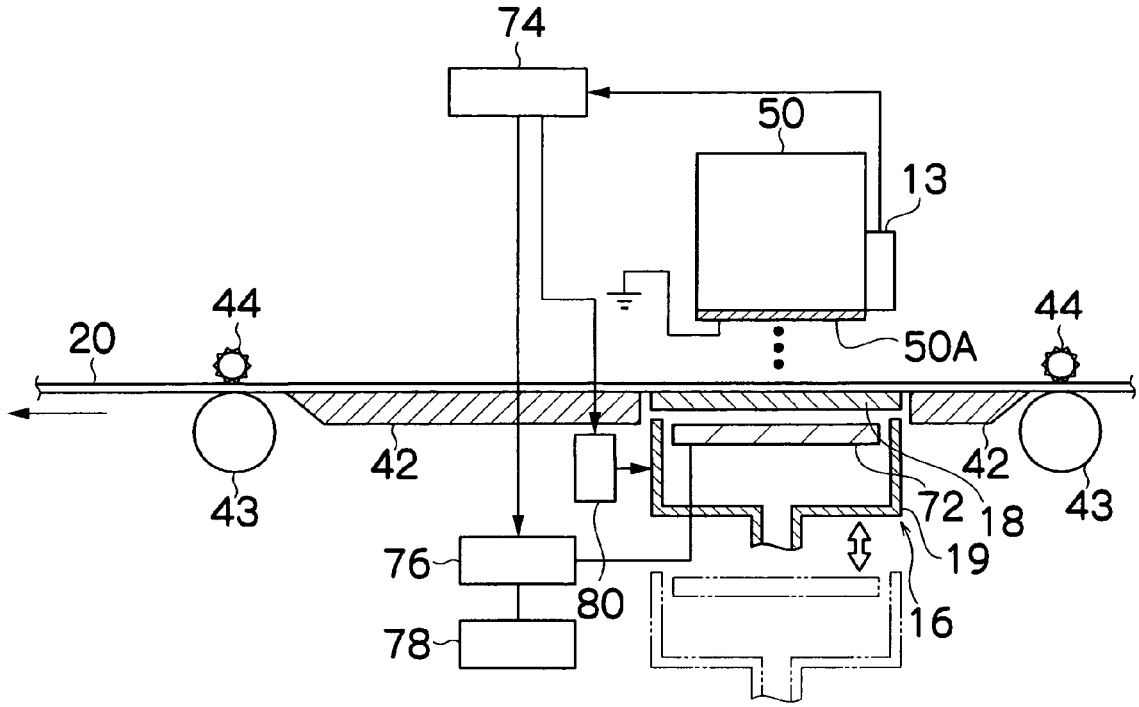
FIG. 10 is an enlarged view of the periphery of a print head according to a second embodiment of the present invention.

FIG. 10 is an enlarged view showing the periphery of a print head according to a second embodiment of the present invention. In FIG. 10, identical reference numerals denote the parts that are common to FIG. 8, and description of these parts has been omitted.

The charging member 72 disposed in the interior of the liquid reception unit 19 is constituted to be capable of traveling upward and downward in conjunction with the liquid reception unit 19. An elevator mechanism 80 raises and lowers the charging member 72 and the liquid reception unit 19 between an operation position shown by the solid lines and a recess position shown by the broken lines in FIG. 10.

Implementation of the present invention is not limited to the method in which the elevator mechanism 80 raises and lowers the charging member 72 and the liquid reception unit 19, and it is also possible to employ a method in which the charging member 72 alone is raised and lowered, a method in which the print head 50 is raised and lowered, a method in which the charging member 72, the liquid reception unit 19, and the print head 50 are raised and lowered relative to each other, or the like.

The control unit 74 controls the voltage adjuster 76 to vary the voltage applied to the charging member 72, and also controls the elevator mechanism 80 to raise and lower the charging member 72 and the liquid reception unit 19 between the recess position and the operation position in FIG. 10.

With this constitution, when the print head 50 switches from a non-ejection state to an ejection state, the control unit 74 controls the voltage adjuster 76 to reduce the voltage applied to the charging member 72, and controls the elevator mechanism 80 to move the charging member 72 from the operation position to the recess position in FIG. 10 so that the distance between the nozzle face 50A and the charging member 72 increases. The control unit 74 may control the elevator mechanism 80 alone. In so doing, the intensity of the electric field between the nozzle face 50A and the recording paper 20 is reduced further than that of the first embodiment, where only the voltage applied to the charging member 72 is controlled. Thereby, the effect of the electric field on the ink droplets can be reduced rapidly.

On the other hand, when the print head 50 switches from an ejection state to a non-ejection state, no ink droplets are ejected from the nozzle 51, and only ink mist exists in the space between the nozzle face 50A and the recording paper 20. Accordingly, the control unit 74 controls the voltage adjuster 76 to increase the voltage applied to the charging member 72, and controls the elevator mechanism 80 to move the charging member 72 from the recess position to the operation position in FIG. 10 so that the distance between the nozzle face 50A and the charging member 72 is reduced. In so doing, the intensity of the electric field between the nozzle face 50A and the recording paper 20 is increased further than that of the first embodiment, where only the voltage applied to the charging member 72 is controlled. Thereby, the effect of the electric field on the ink mist can be increased rapidly, and the ink mist can be attracted onto the charging member 72 more reliably.

When the charging member 72 is charged excessively, the control unit 74 controls the voltage adjuster 76 to apply to the charging member 76 a voltage that forms a zero or inverse electric field. The control unit 74 then controls the elevator mechanism 80 to move the charging member 72 from the operation position to the recess position in FIG. 10 so that the distance between the nozzle face 50A and the charging member 72 is increased. In so doing, the effect of the electric field on the ink droplets can be reduced rapidly.

In the present embodiment, the intensity of the electric field in the space between the nozzle face 50A and the recording paper 20 can be greatly varied not only by varying the voltage applied to the charging member 72, but also by varying the relative distance between the charging member 72 and the nozzle face 50A. Thus, the effect of the electric field on the ink droplets and the ink mist can be reduced or increased rapidly.

When the charging member 72 is formed to be large in accordance with the elongated print heads 50, it is particularly preferable that the effect of the electric field on the ink droplets and the ink mist can be reduced or increased rapidly by controlling not only the voltage applied to the charging member 72, but also the elevator mechanism 80 as described above.

Figure 11:
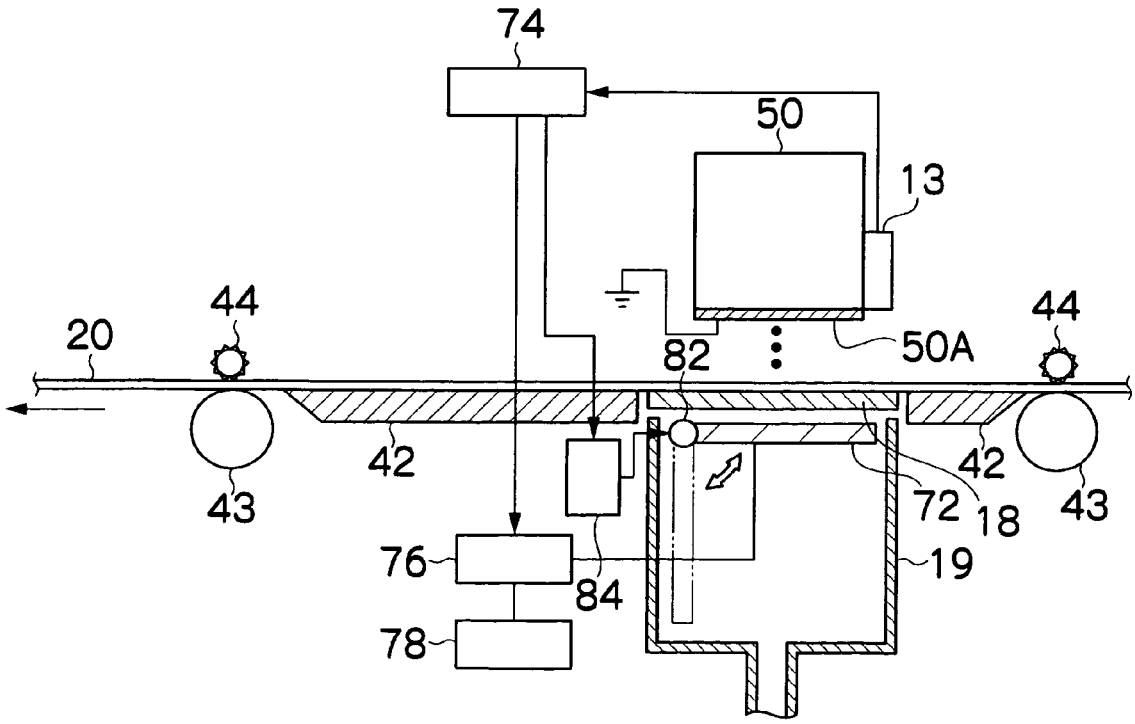
FIG. 11 is an enlarged view of the periphery of a print head according to a third embodiment of the present invention.

FIG. 11 is an enlarged view showing the periphery of a print head according to a third embodiment of the present invention. In FIG. 11, identical reference numerals denote the parts that are common to FIG. 8, and description thereof has been omitted.

One end of the charging member 72 disposed in the interior of the liquid reception unit 19 is supported rotatably by a support shaft 82 so as to be capable of rotating about the support shaft 82. A rotation mechanism 84 rotates the charging member 72 between an operation position shown by the solid lines and a recess position shown by the broken lines in FIG. 11.

The control unit 74 controls the voltage adjuster 76 to vary the voltage applied to the charging member 72, and also controls the rotation mechanism 84 to rotate the charging member 72 between the operation position and the recess position in FIG. 11.

When the charging member 72 is rotated from the operation position to the recess position in FIG. 11 by the control unit 74, the distance between the charging member 72 and the nozzle face 50A increases relatively, and hence the intensity of the electric field in the space between the nozzle face 50A and the recording paper 20 decreases further than that of the first embodiment, where only the voltage applied to the charging member 72 is varied. Thereby, the effect of the electric field on the ink droplets can be reduced rapidly.

When the charging member 72 is rotated from the recess position to the operation position in FIG. 11, the distance between the charging member 72 and the nozzle face 50A decreases relatively, and hence the intensity of the electric field in the space between the nozzle face 50A and the recording paper 20 increases further than that of the first embodiment, where only the voltage applied to the charging member 72 is varied. Thereby, the effect of the electric field on the ink droplets can be increased rapidly.

In the third embodiment, similarly to the second embodiment, the effect of the electric field on the ink droplets and the ink mist can be reduced or increased rapidly.

Figure 12:
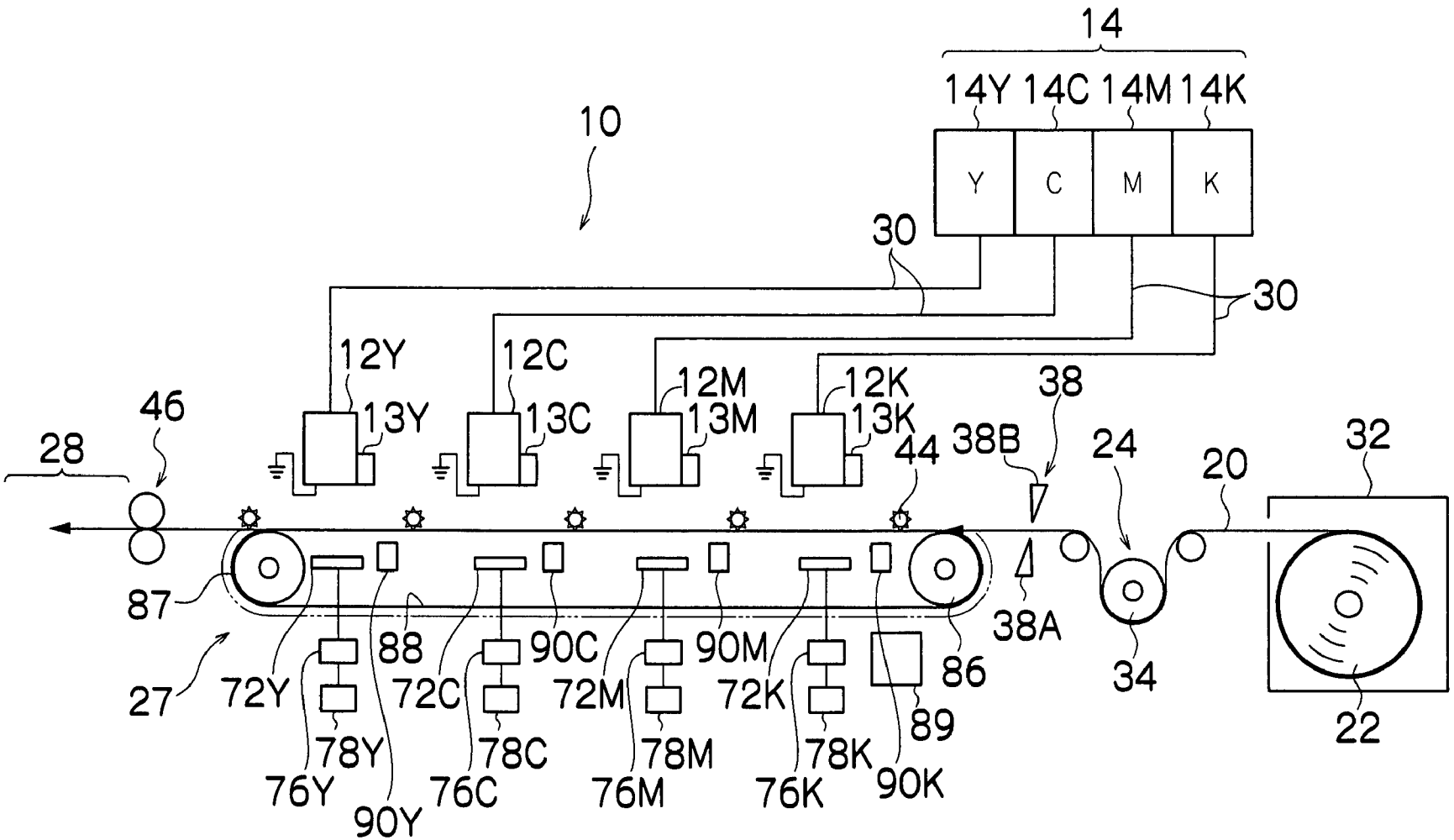
FIG. 12 is a general schematic drawing of an inkjet recording apparatus according to a fourth embodiment of the present invention.

FIG. 12 is a general schematic drawing showing an inkjet recording apparatus according to a fourth embodiment of the present invention. In FIG. 12, identical reference numerals denote the parts that are common to FIG. 1, and description thereof has been omitted.

In the fourth embodiment, a suction belt conveyance unit 27, which conveys the recording paper 20, is configured such that a belt 88 is set around rollers 86, 87, and at least a part of the belt 88 that faces the nozzle faces of the print heads 12K, 12M, 12C, 12Y forms a horizontal plane (flat surface).

The width dimension of the belt 88 is greater than the width of the recording paper 20, and a large number of suction holes (not shown) are formed in the belt surface. A suction chamber (not shown) is provided on the inside of the belt 88 set around the rollers 86, 87, and by applying suction to the suction chamber using a fan so that negative pressure acts on the suction chamber, the recording paper 20 is held on the belt 88 by suction.

The charging members 72K, 72M, 72C, 72Y are arranged in positions facing the nozzle faces of the respective print heads 12K, 12M, 12C, 12Y with the recording paper 20 therebetween, or in other words facing the nozzle faces across the belt 88.

The charging members 72K, 72M, 72C, 72Y are connected to the power source units 78K, 78M, 78C, 78Y through the voltage adjusters 76K, 76M, 76C, 76Y, respectively. Similarly to the first embodiment, the voltage applied to the charging members 72K, 72M, 72C, 72Y is controlled by the control unit 74 (not shown in FIG. 12, but shown in FIG. 8).

Neutralizing brushes 90K, 90M, 90C, 90Y for neutralizing the belt 88 are provided on the respective upstream sides of the charging members 72K, 72M, 72C, 72Y. When the recording paper 20 conveyed by the belt 88 is charged, the electric field generated by the charge affects the liquid droplets ejected from the downstream side print head 12Y and so on by altering the flight direction of the droplets, which may lead to a deterioration in image quality. Hence, the belt 88 conveying the recording paper 20 is neutralized by the neutralizing brushes 90K, 90M, 90C, 90Y to prevent charging of the recording paper 20. Instead of the neutralizing brushes 90K, 90M, 90C, 90Y, the belt 88 may be neutralized by grounding the rollers 86, 87.

A cleaning member 89 formed from a sponge or the like is disposed on the lower surface of the belt 88 (opposite the side on which the recording paper 20 is conveyed). The cleaning member 89 is capable of sliding over the surface of the belt 88 to remove ink mist that becomes adhered to the surface of the belt 88 when the ink mist is attracted toward the charging members 72K, 72M, 72C, 72Y.

According to this constitution, similarly to the first embodiment, the ink mist can be attracted toward the charging members 72K, 72M, 72C, 72Y, so that the ink mist can be prevented from adhering to the nozzle face of the print heads 12K, 12M, 12C, 12Y, without affecting the ink droplets ejected from the print heads 12K, 12M, 12C, 12Y.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which ejects a droplet of liquid onto a recording medium;

an electric field generating device which generates an electric field, the electric field generating device being arranged in a position facing an ejection face of the ejection head across the recording medium;

a control device which controls intensity of the electric field to attract mist of the liquid toward the electric field generating device, the mist of the liquid being produced when the droplet of the liquid is ejected by the ejection head; and a movement device which adjusts distance between the electric field generating device and the ejection head, wherein:

based on the occurrence the ejection head switching from a non-ejection state to an ejection state, the control device reduces voltage applied to the electric field generating device to reduce the intensity of the electric field generated by the electric field generating device, and controls the movement device to increase the distance between the electric field generating device and the ejection head; and based on the occurrence the ejection head switching from the ejection state to the non-ejection state, the control device increases the voltage applied to the electric field generating device to increase the intensity of the electric field generated by the electric field generating device, and controls the movement device to reduce the distance between the electric field generating device and the ejection head.

2. The image forming apparatus as defined in claim 1, further comprising:

a measurement device which measures the intensity of the electric field in a flight space of the droplet of the liquid and the mist of the liquid, wherein the control device controls the intensity of the electric field generated by the electric field generating device according to the electric field intensity measured by the measurement device.

3. The image forming apparatus as defined in claim 2, wherein the measurement device measures a potential difference between the recording medium and the ejection head.

4. The image forming apparatus as defined in claim 1, wherein the control device controls the intensity of the electric field in a flight space of the droplet of the liquid and the mist of the liquid to no less than 1.19kV/m and less than 2.46kV/in during the ejection head ejecting the droplet of the liquid.

5. The image forming apparatus as defined in claim 1, wherein:

the plurality of ejection heads are provided; and the plurality of electric field generating devices are provided to associate with the plurality of ejection heads respectively.

6. The image forming apparatus as defined in claim 1, wherein the electric field generating device is disposed so as not to contact with the recording medium.

7. The image forming apparatus as defined in claim 6, wherein the electric field generating device is disposed in a position facing an ejection face of the ejection head across the recording medium so as not to contact with a supporting member supporting the recording medium.

8. The image forming apparatus as defined in claim 1, further comprising a liquid collection unit which has an opening on a side of the ejection head, and in an interior of which the electric filed device is disposed.

* * * * *